US009969540B2

(12) United States Patent
Hanrahan

(10) Patent No.: US 9,969,540 B2
(45) Date of Patent: May 15, 2018

(54) COMPRESSION CORD SLEEVE

(71) Applicant: Kevin C. Hanrahan, Greene, NY (US)

(72) Inventor: Kevin C. Hanrahan, Greene, NY (US)

( * ) Notice: Subject to any disclaimer, the term of this patent is extended or adjusted under 35 U.S.C. 154(b) by 289 days.

(21) Appl. No.: 15/009,974

(22) Filed: Jan. 29, 2016

(65) Prior Publication Data

US 2017/0057713 A1 Mar. 2, 2017

Related U.S. Application Data

(60) Provisional application No. 62/208,959, filed on Aug. 24, 2015.

(51) Int. Cl.

| | |
|---|---|
| ***B65D 63/10*** | (2006.01) |
| ***B65D 63/18*** | (2006.01) |
| ***G09F 3/02*** | (2006.01) |
| ***B65D 75/02*** | (2006.01) |
| ***B65D 75/56*** | (2006.01) |
| ***B65D 85/04*** | (2006.01) |

(52) U.S. Cl.

CPC ..... *B65D 63/109* (2013.01); *B65D 63/18* (2013.01); *B65D 75/02* (2013.01); *B65D 75/563* (2013.01); *B65D 85/04* (2013.01); *B65D 2563/108* (2013.01)

(58) Field of Classification Search

CPC ..... B65D 63/109; B65D 63/18; B65D 85/04; B65D 75/563; B65D 75/02; B65D 2563/108

See application file for complete search history.

(56) References Cited

U.S. PATENT DOCUMENTS 4,540,614 A * 9/1985 Omori ..... B65B 27/08 206/451

2014/0151263 A1* 6/2014 Braz ..... B65D 75/02 206/702

* cited by examiner

*Primary Examiner* — Robert Sandy
*Assistant Examiner* — Louis A Mercado

(57) ABSTRACT

A compression cord sleeve bundles a flexible elongated cord, such as cables, electrical cords, or wires, for storage or transportation. The compression cord sleeve includes a tubular sleeve body and a handle. The tubular sleeve body compresses around the flexible elongated cord in order to prevent the flexible elongated cord from unraveling or uncoiling. The tubular sleeve body is manipulated around a coiled or wrapped flexible elongated cord such that the tubular sleeve body compresses the coiled or wrapped flexible elongated cord radially. The handle allows a user to grasp the compression cord sleeve for ease of transportation.

13 Claims, 5 Drawing Sheets

COMPRESSION CORD SLEEVE

The current application claims a priority to the U.S. Provisional Patent application Ser. No. 62/208,959 filed on Aug. 24, 2015.

FIELD OF THE INVENTION

The present invention relates generally to cord organization accessories. More specifically, the present invention is a sleeve for neatly containing cords, hoses, and cables.

BACKGROUND OF THE INVENTION

Ropes, electrical extension cords, and cables are widely used across numerous professional and household applications. After use ropes, electrical extension cords, and cables are typically unraveled or disheveled. Traditionally, a person generally coils or uses a wrapping apparatus to prepare the ropes, electrical extension cords, or cables for storage; however, these traditional methods of wrapping or coiling these cords, including but not limited to ropes, electrical extension cords, cables, etc., puts fatigue on the cordlike strands or tangles during coiling such that the cords twists upon itself and cannot be easily unraveled.

Therefore, it is an object of the present invention to bundle such cords for storage and transportation. The compression cord sleeve is manipulated by a user over a coiled cord to bind the coiled cord to prevent the coil from unraveling during transportation. The present invention constricts the coiled cord to prevent the coiled cord from having to wrap around itself to bundle the cord and therefore reducing the stress of the coiled cord from wrapping about itself.

DETAIL DESCRIPTIONS OF THE INVENTION

All illustrations of the drawings are for the purpose of describing selected versions of the present invention and are not intended to limit the scope of the present invention.

The present invention is a compression cord sleeve. The present invention is used to bind and contain a flexible elongated cord, such as electrical extension cords, cables, ropes, and similar cord-like bodies. The present invention is manipulated over a coiled cord to restrain the coiled cord from unraveling during transportation and storage.

Figure 1:
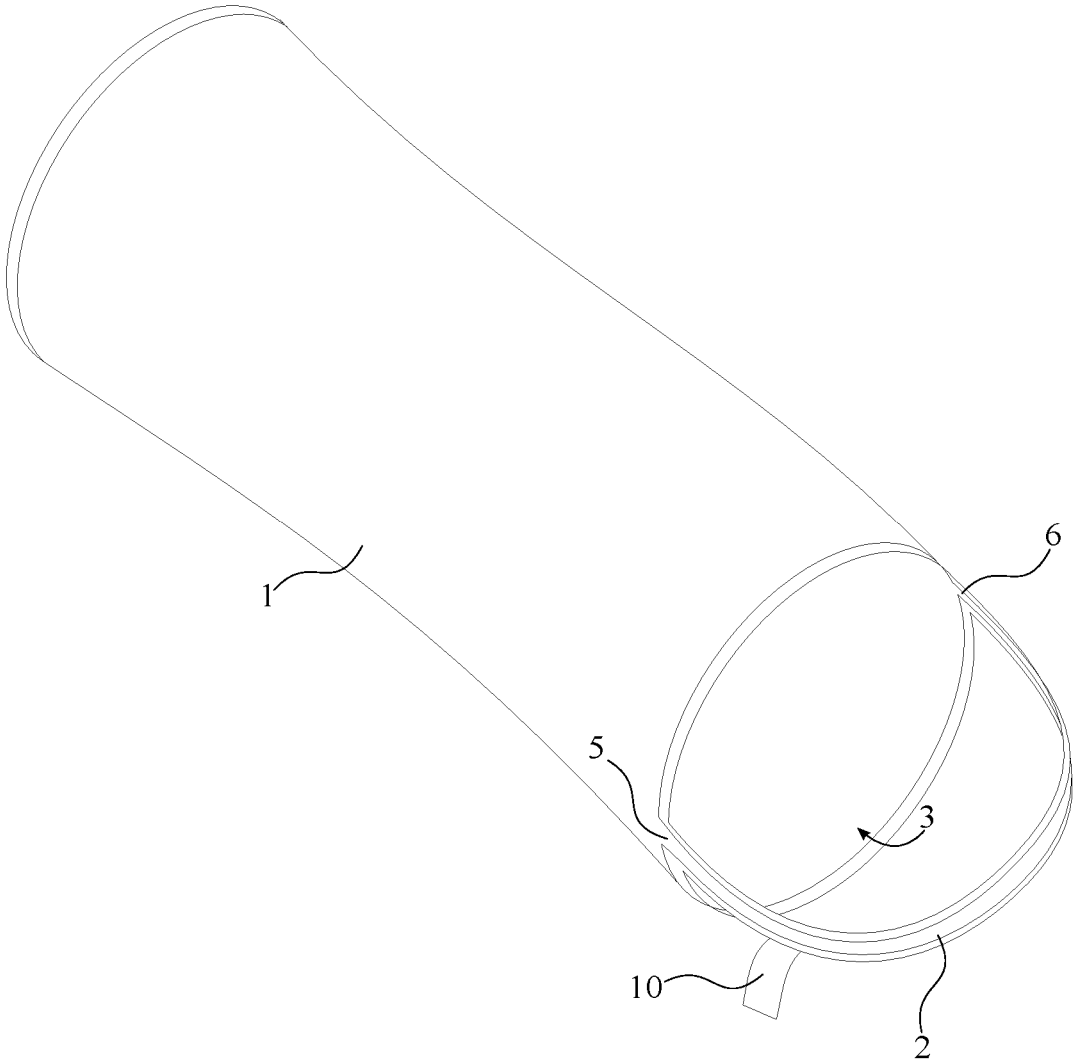
FIG. 1 is a perspective view of the present invention.
Figure 2:
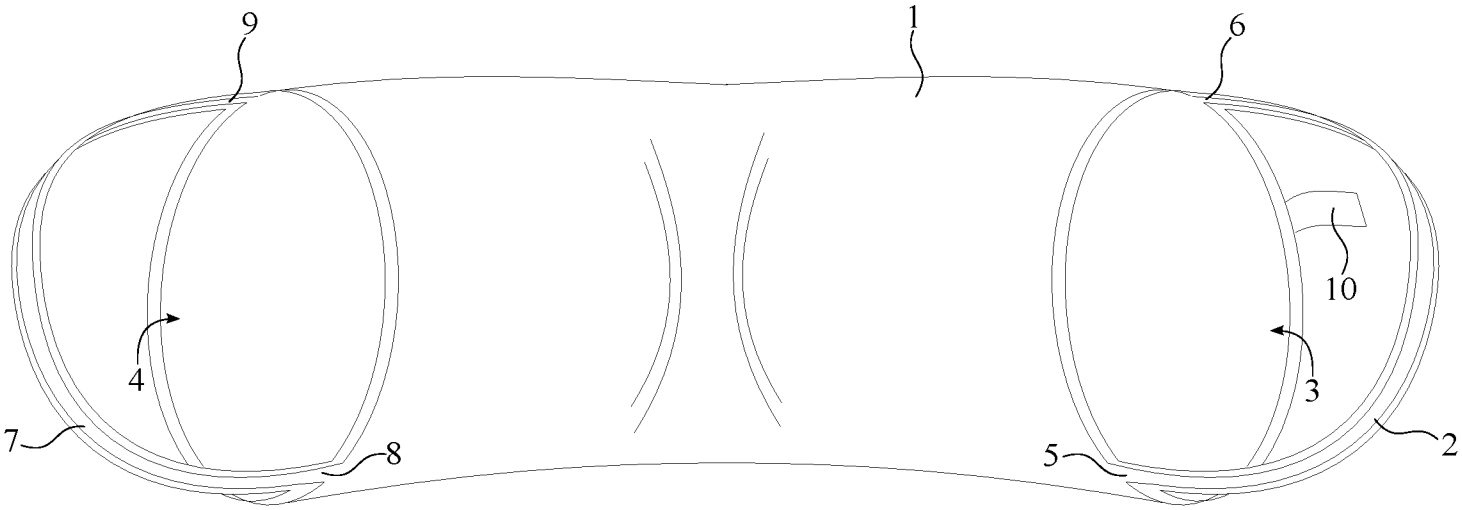
FIG. 2 is a side view of the present invention, wherein the tubular sleeve body is bent in order to exemplify the first open end, the second open end, and the additional handle.

In order to compress and restrain a coiled cord, the present invention comprises a tubular sleeve body 1 and a handle 2, in accordance to FIG. 1. The tubular sleeve body 1 bounds a coiled cord from unraveling. The handle 2 allows for ease of storage, for example hanging the coiled cord, and transportation as the user is able grasp the handle 2 for manipulation of the present invention and the corded coiled bound by the present invention. The tubular sleeve body 1 comprises a first open end 3 and a second open end 4. The first open end 3 is opposite to the second open end 4 along the tubular sleeve body 1, as shown in FIG. 2. The tubular sleeve body 1 is elastic such that the tubular sleeve body 1 is easily manipulated over a coiled cord. The first open end 3 and the second open end 4 allow the positioning of a flexible elongated cord 11 within the present invention. The handle 2 is positioned across the first open end 3 in order to evenly distribute the weight of a flexible elongated cord 11 across a diameter of the tubular sleeve body 1. The handle 2 comprises a first handle end 5 and a second handle end 6 to mount the handle 2 onto the tubular sleeve body 1. The first handle end 5 and the second handle end 6 are diametrically opposed to each other around the first open end 3. The first handle end 5 and the second handle end 6 are permanently fixed to the tubular sleeve body 1. The handle 2 is preferred to be elastic as the handle 2 is an extension of the elastic material in order to allow the handle 2 to stretch away from the tubular sleeve body 1 such that the present invention is able to be hung by the handle 2.

In some embodiments of the present invention, the present invention comprises an additional handle 7, as shown in FIG. 2. The additional handle 7 allows the user to manipulate or hang the present invention, similar to the aforementioned handle 2. Similarly, the additional handle 7 comprises a first handle end 5 and a second handle end 6 to mount the additional handle 7 to the tubular sleeve body 1. The first additional handle end 8 and the second additional handle end 9 are diametrically opposed to each other around the second open end 4. The first additional handle end 8 and the second additional handle end 9 are removably fastened to the tubular sleeve body 1 by a snap button, hook and loop fastener, or any other appropriate means of fastening.

The tubular sleeve body 1, the handle 2 and the additional handle 7 are preferred to be made from an elastane material. Therefore, the tubular sleeve body 1, the handle 2 and the additional handle 7 are elastic such that the tubular sleeve body 1, the handle 2, and the additional handle 7 are able to deform along the material when a force is applied to each and easily return to its original dimensions. The tubular sleeve body 1 is preferred to be manufactured with an un-stretched diameter between three to four inches. The tubular sleeve body 1 is radially elastic such that the tubular sleeve body is then able to stretch and have a diameter between eight to ten inches. Thus, the tubular sleeve body 1 is able to sufficiently expand over and cincture about the flexible elongated cord 11. The length of the tubular sleeve body 1 is preferred to be between sixteen and twenty-four inches long in order to sufficiently confine a flexible elongated cord 11.

In some embodiments of the present invention, the present invention comprises a labeling tag 10. The labeling tag 10 allows for a printable graphic or text to be superimposed on the labeling tag 10 for display. In one configuration, the labeling tag 10 is mounted onto the tubular sleeve body 1 such that the labeling tag 10 is easily found by a user to view the printable graphic or text, as shown in FIG. 2. In another configuration, the labeling tag 10 is mounted onto the handle 2 to be easily accessible to the user, as detailed in FIG. 1.

Figure 3:
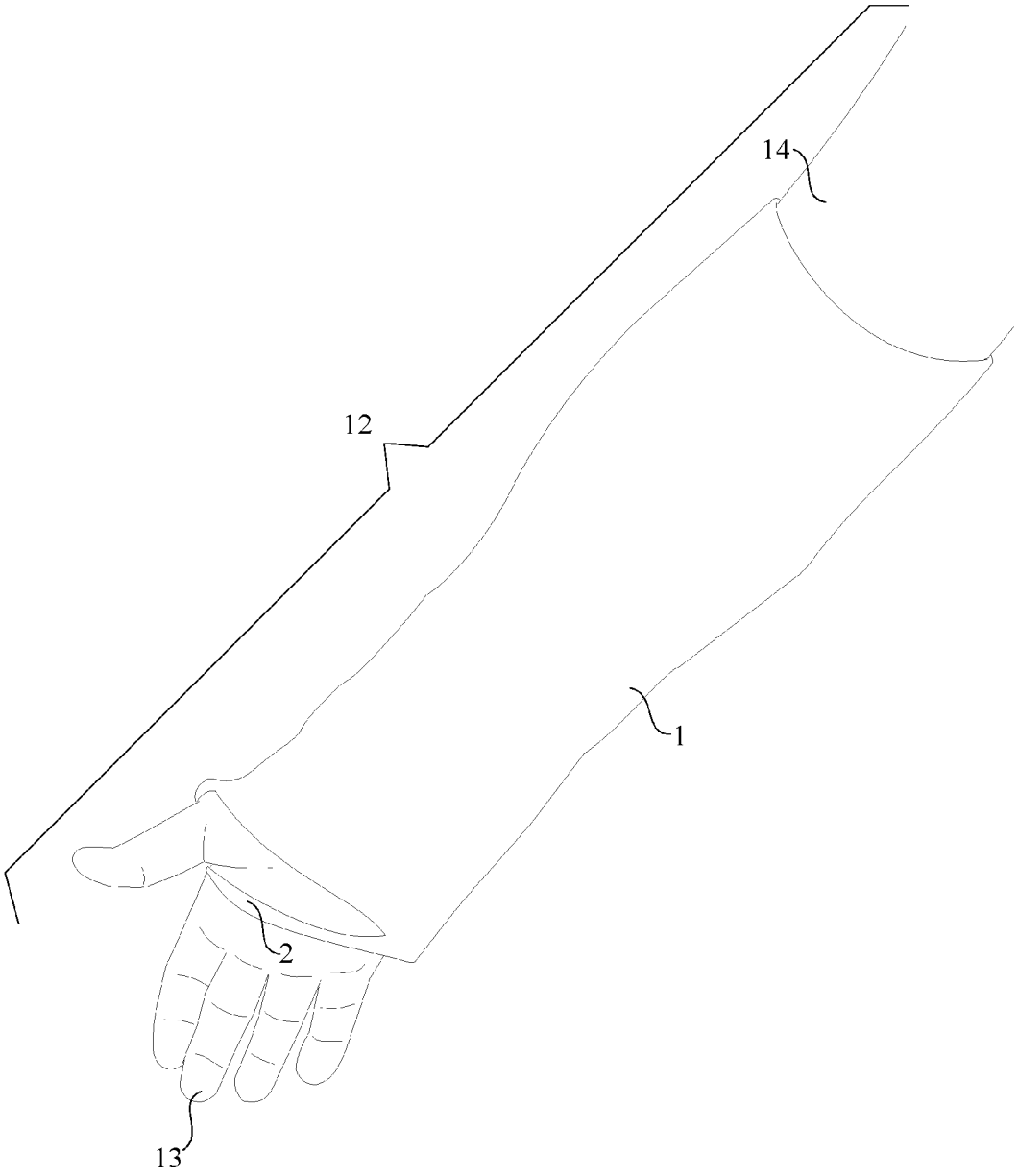
FIG. 3 is front view of the present invention, wherein the present invention is inverted onto a packing arm.
Figure 4:
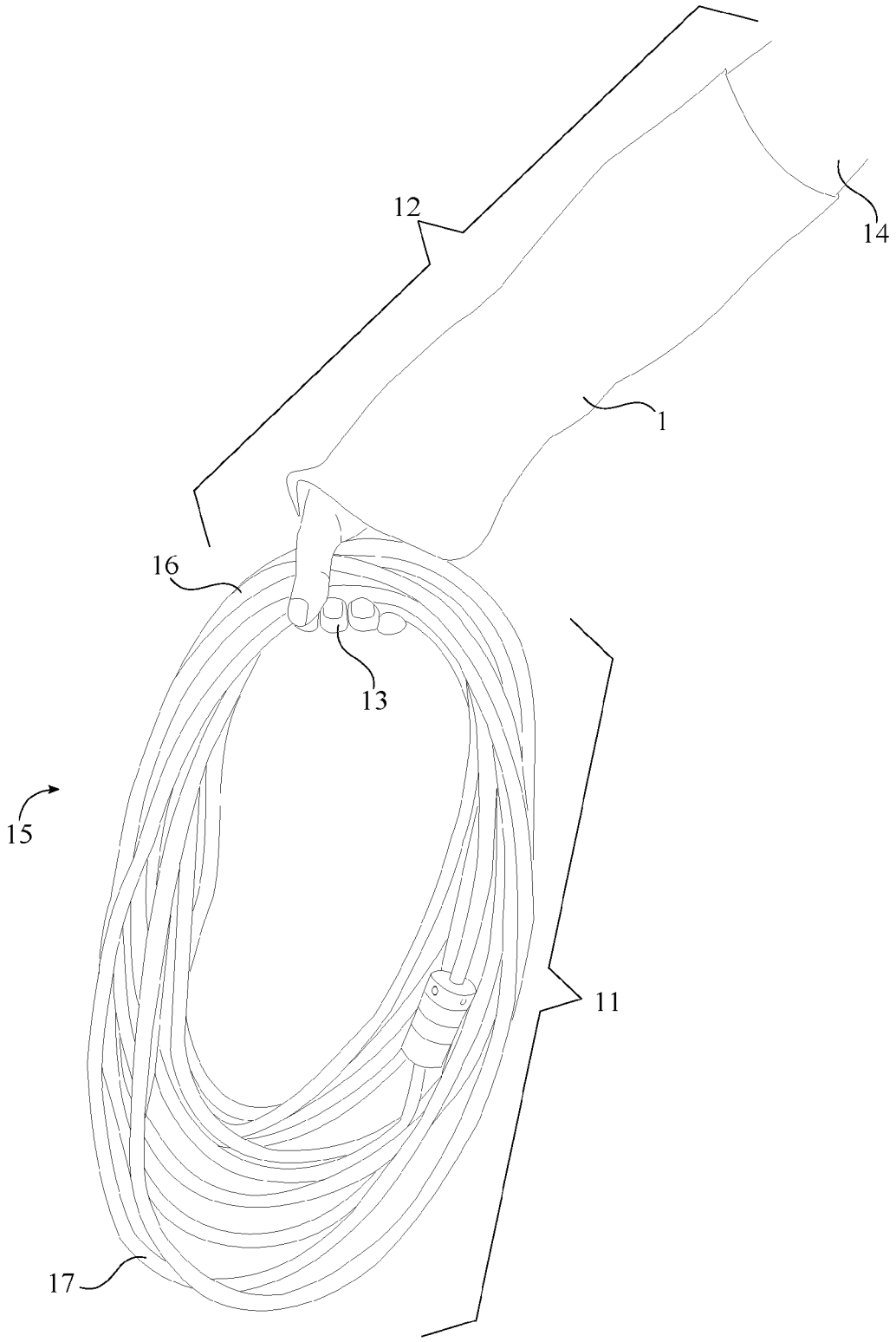
FIG. 4 is a front view of the present invention, wherein the grasping arm attaches to the first peripheral end of a flexible elongated cord in a condensed configuration.
Figure 5:
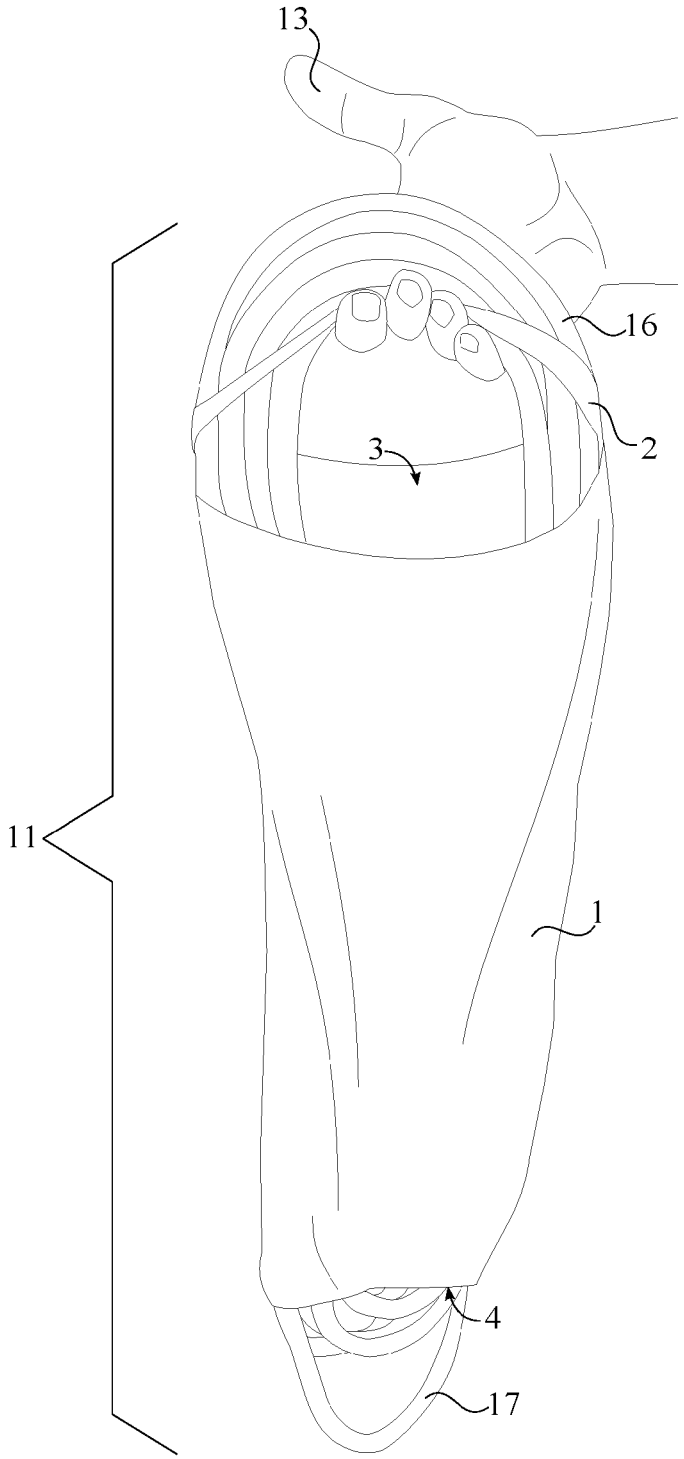
FIG. 5 is a front view of the present invention, wherein the present invention is positioned about a flexible elongated cord in a condensed configuration.

As described, the present invention is intended to confine a provided flexible elongated cord 11 for storage and transportation. Further, a packaging arm 12 is necessary to execute a method of use of the present invention, wherein the packaging arm 12 comprises a grasping end 13 and a free end 14. The packaging arm 12 is a human arm or a mechanical arm which is capable of grasping and supporting the present invention as the present invention is manipulated over the flexible elongated cord 11. The grasping end 13 holds the present invention and the flexible elongated cord 11, while the free end 14 allows the present invention to rest the preset invention on while in some transitional steps of process. Initially, the flexible elongated cord 11 is bundled into a condensed configuration 15, typically a coiled configuration, wherein the condensed configuration 15 comprises a first peripheral end 16 and a second peripheral end 17. The handle 2 is attached to the grasping end 13. Subsequently, the tubular sleeve body 1 is inverted by forcing the handle 2 and the grasping end 13 through the first open end 3, through the tubular sleeve body 1, through the second open end 4 and by pulling the second open end 4 towards the free end 14, in accordance to FIG. 3. As shown in FIG. 4, the first peripheral end 16 is then attached to the grasping end 13. The tubular sleeve body 1 is then reverted to its original configuration by forcing the grasping end 13 and the first peripheral end 16 through the first open end 3, through the tubular sleeve body 1, through the second open end 4, and by pulling the second open end 4 towards the second peripheral end 17. Thus, the present invention is positioned over the flexible elongated cord 11, as shown in FIG. 5. The grasping end 13 is then detached from the first peripheral end 16 such that the bundled flexible elongated cord 11 is able to be transported or stored.

Although the invention has been explained in relation to its preferred embodiment, it is to be understood that many other possible modifications and variations can be made without departing from the spirit and scope of the invention as hereinafter claimed.

What is claimed is:

1. A compression cord sleeve comprises:
a tubular sleeve body;
a handle;
the tubular sleeve body comprises a first open end and a second open end;
the handle comprises a first handle end and a second handle end;
the tubular sleeve body being radially elastic;
the first open end being opposite to the second open end along the tubular sleeve body;
the handle being positioned across the first open end;
the first handle end and the second handle end being diametrically opposed to each other around the first open end; and
the first handle end and the second handle end being permanently fixed to the tubular sleeve body.

2. The compression cord sleeve, as claimed in claim 1, wherein the handle is elastic.

3. The compression cord sleeve, as claimed in claim 1, comprises:
an additional handle;
the additional handle comprises a first additional handle end and a second additional handle end;
the first additional handle end and the second additional handle end being diametrically opposed to each other around the second open end; and
the first additional handle end and the second additional handle end being removably fastened to the tubular sleeve body.

4. The compression cord sleeve, as claimed in claim 3, wherein the additional handle is elastic.

5. The compression cord sleeve, as claimed in claim 3, wherein the additional handle is made of an elastane material.

6. The compression cord sleeve, as claimed in claim 1, wherein an un-stretched diameter of the tubular sleeve body is between three to four inches.

7. The compression cord sleeve, as claimed in claim 1, wherein a stretched diameter of the tubular sleeve body is between eight to ten inches.

8. The compression cord sleeve, as claimed in claim 1, wherein a length of the tubular sleeve body is between sixteen and twenty-four inches.

9. The compression cord sleeve, as claimed in claim 1, wherein the tubular sleeve body is made of an elastane material.

10. The compression cord sleeve, as claimed in claim 1, wherein the handle is made of an elastane material.

11. The compression cord sleeve, as claimed in claim 1, comprises:
a labeling tag; and
the labeling tag being mounted onto the tubular sleeve body.

12. The compression cord sleeve, as claimed in claim 1, comprises:
a labeling tag; and
the labeling tag being mounted onto the handle.

13. A method of use for the compression cord sleeve, as claimed in claim 1, comprises the steps of:
providing a flexible elongated cord;
providing a packaging arm, wherein the packaging arm comprises a grasping end and a free end;
bundling the flexible elongated cord into a condensed configuration, wherein the condensed configuration comprises a first peripheral end and a second peripheral end;
attaching the handle to the grasping end;
inverting the tubular sleeve body by forcing the handle and the grasping end through the first open end, through the tubular sleeve body, through the second open end and by then pulling the second open end towards the free end;
attaching the first peripheral end to the grasping end;
reverting the tubular sleeve body by forcing the grasping end and the first peripheral end through the first open end, through the tubular sleeve body, through the second open end and by then pulling the second open end towards the second peripheral end; and
detaching the grasping end from the first peripheral end.

* * * * *